United States Patent [19]

Teshima et al.

[11] 4,234,817

[45] Nov. 18, 1980

[54] FLAT TYPE FLUORESCENT LAMP

[75] Inventors: Toru Teshima, Yokohama; Kazuo Ariga, Tokyo; Mitunari Yoshida, Yokohama, all of Japan

[73] Assignee: Stanley Electric Co., Ltd., Tokyo, Japan

[21] Appl. No.: 1,284

[22] Filed: Jan. 4, 1979

[30] Foreign Application Priority Data

Jan. 26, 1978 [JP] Japan ..... 53-8029

[51] Int. Cl.[3] ..... H01J 61/30; H01J 61/42

[52] U.S. Cl. ..... 313/493; 313/220

[58] Field of Search ..... 313/493, 220, 317

[56] References Cited

U.S. PATENT DOCUMENTS

| | | | |
|---|---|---|---|
| 2,255,431 | 9/1941 | Marden et al. | 313/220 X |
| 2,364,889 | 12/1944 | Blair | 313/220 X |
| 2,555,749 | 6/1951 | Krefft | 313/220 X |
| 3,189,395 | 6/1965 | Demas | 313/222 X |
| 3,845,347 | 10/1974 | Tanji | 313/220 X |
| 4,140,938 | 2/1979 | Mueller et al. | 313/220 X |

FOREIGN PATENT DOCUMENTS

| | | | |
|---|---|---|---|
| 2427734 | 1/1975 | Fed. Rep. of Germany | 313/220 |
| 2803462 | 8/1978 | Fed. Rep. of Germany | 313/220 |

*Primary Examiner*—Palmer C. Demeo

*Attorney, Agent, or Firm*—Frishauf, Holtz, Goodman & Woodward

[57] ABSTRACT

A flat type fluorescent lamp comprises a molded plate glass in the form of an upside down dished plate and a flat plate sealed to the dished plate along the peripheral portions thereof. A pair of electrodes are mounted on the flat plate glass, spaced from the flat plate glass, through stems or connector pins and are sealed in the fluorescent lamp body. The fluorescent lamp requires no base so that the overall length thereof may be reduced.

4 Claims, 7 Drawing Figures

FLAT TYPE FLUORESCENT LAMP

BACKGROUND OF THE INVENTION

1. Field of the Invention

This invention relates to a flat type fluorescent lamp.

2. Description of the Prior Art

A conventional fluorescent lamp normally has a lamp body in the form of an elongated tube, opposite ends of which enclose a pair of electrodes, the electrodes usually comprising a tungsten filament on which an electronic radiation material is coated. The tube has a few mmHg of rare gas (mainly, argon) sealed therein so that the lamp easily goes on in addition to a small quantity of mercury, the tube further having the inner wall surface thinly and evently coated with a fluorescent material. The fluorescent lamp has bases and base pins mounted on the opposite ends of the tube, and the electrodes are energized through the base pins. In this case, as long as the lamp is used as an illuminating lamp for illuminating the interior of room or the like with the former attached to the mounting device for the fluorescent lamp, there involves no trouble. However, in the case where the lamp is used for special uses, for example, it is incorporated into a display device, base receptacles for the mounting of lamp must be mounted on the display device, and as a result, longer dimensions are required for the display device since the base portions of the fluorescent lamp are limited to the opposite ends of the lamp body, thus posing inconveniences such that more space is required for the lamp to be mounted and that the mounting position thereof is limited. Further, in the case where the display portion of the display device has a wide area, it is impossible to illuminate the display portion with an even brightness by use of a single fluorescent lamp.

SUMMARY OF THE INVENTION

The present invention overcomes the disadvantages noted above with respect to prior art devices by providing an arrangement whereby a molded plate glass in the shape of an upside down dished plate and a flat plate glass have to peripheral overlapping edge portions joined together to form a flat type fluorescent lamp body. A pair of electrodes are mounted spaced from one of the plate glass members through stems or connector pins, passing through said one plate glass member the electrodes being sealed in the fluorescent lamp body.

DESCRIPTION OF THE PREFERRED EMBODIMENTS

Figure 1:
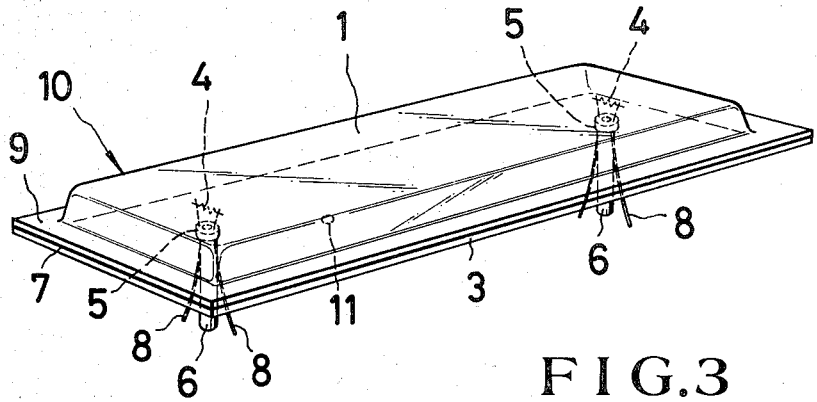
FIG. 1 is a perspective view showing a construction of a flat type fluorescent lamp in accordance with the present invention.
Figure 3:
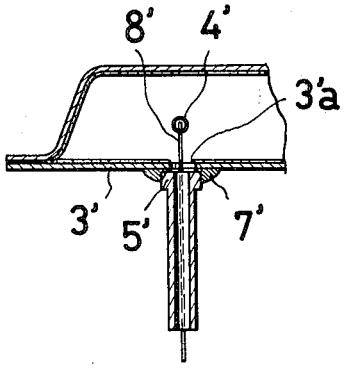
FIG. 3 is a sectional view showing another mode of mounting a button stem.
Figure 2:
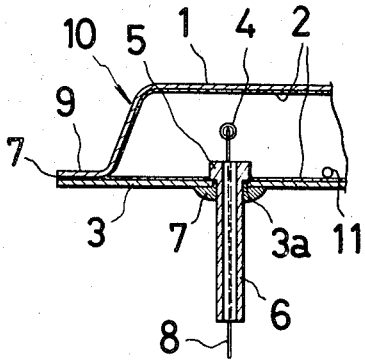
FIG. 2 is an enlarged sectional view of a principal portion of FIG. 1.

Referring now to FIGS. 1 and 2, there is shown a plate glass 1 formed into a shape of a rectangular recessed plate which is placed upside down. The lower surface of the plate glass, 1 that is, the inner wall surface of the cavity thereof, is coated with a fluorescent material 2. The reference numeral 3 denotes a flat plate glass of which the upper surface is similarly coated with the fluorescent material 2 and has a pair of electrodes 4 mounted thereon and spaced from the coated surface thereof through button stems 5 and 5. The button stem 5 is secured to the flat plate glass 3 by inserting from the top an exhaust pipe 6, (having the button stem 5 at an end thereof) which is mounted on the lower surface thereof, into a hole **3*a* bored in the flat plate glass 3 as shown in FIG. 2 and locking it in place by adhesives or molten glass 7. The electrode 4 is mounted on the foremost end of a lead-in wire 8 supported on the button stem 5. In this case, the hole 3*a* of the flat plate glass 3 has a diameter larger than the outside diameter of the exhaust pipe 6 but smaller than the outside diameter of the button stem 5. The mounting of the button stem 5 may also be accomplished in a manner shown in FIG. 3 wherein the diameter of a hole 3'*a* in a flat plate glass 3' is made smaller than the outside diameter of a button stem 5', a lead-in wire 8' is inserted from the button in to the hole 3'*a*, and the button stem 5' is directly secured to the flat plate glass 3' by use of adhesives or molten glass 7'. In this case, however, an electrode 4' may be mounted on the lead-in wire 8' after the button stem 5'** has been mounted.

Figure 4:
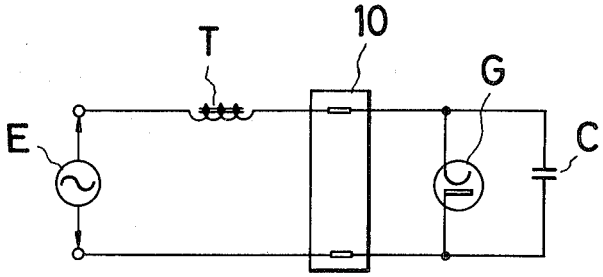
FIG. 4 is a circuit diagram for lighting the lamp.

In either of the above constructions, the pair of electrodes 4 are mounted spaced from the flat plate glass 3, and thereafter the molded plate glass 1 in the form of an upside down dished plate is put on the flat plate glass 3 so that peripheral edge overlapping portions 9 thereof are joined together by adhesives or molten glass 7 to thereby form a fluorescent lamp body 10. Next, the lamp body 10 is evacuated by the exhaust pipe 6 and filled with a predetermined quantity of mercury 11 and argon gas, after which the exhuast pipe 6 is subjected to chipping off (sealed) to complete a flat plate type fluorescent lamp. Then, the lead-in wire 8, which extends externally of the fluorescent lamp from the hole **3*a* in the flat plate glass 3 may be connected to lighting circuit as shown in FIG. 4, for example, to thereby light the fluorescent lamp. In FIG. 4, the reference character G designates a glow switch; C, a capacitor; T, choke transformer; 10**, the lamp and E, a power source.

Figure 5:
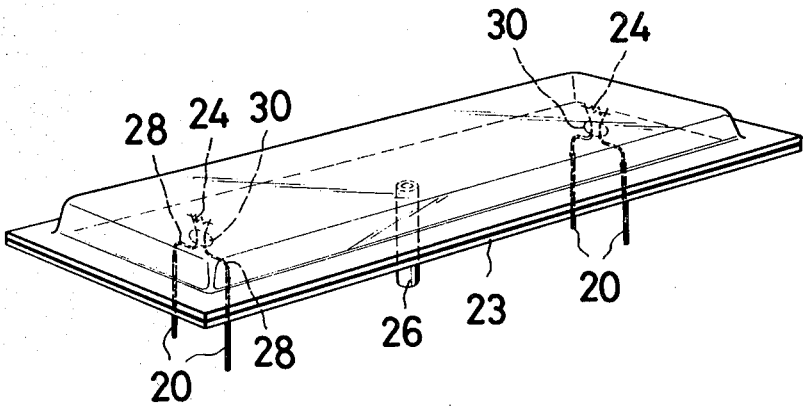
FIG. 5 is a perspective view of a modified embodiment of a flat type fluorescent lamp in accordance with the present invention.
Figure 6:
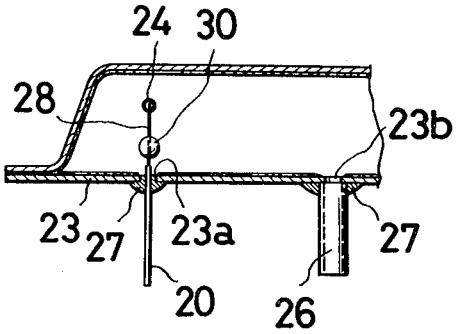
FIG. 6 is an enlarged sectional view of a principal portion of FIG. 5.
Figure 7:
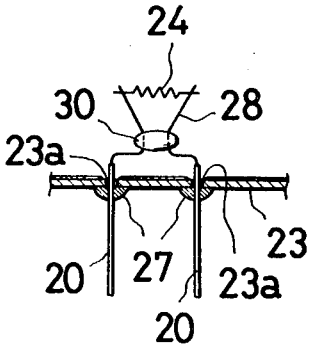
FIG. 7 is an explanatory view showing the mode of mounting the electrode in the embodiment of FIG. 5.

In FIG. 5, there is shown another embodiment of the present invention, in which a pair of electrodes 24 are mounted spaced from a flat plate glass 23 through connector pins 20. That is, as shown in FIGS. 6 and 7, a pair of connector pins 20 are inserted from the bottom into a small hole **23*a* bored in the flat plate glass 23 and locked in place by adhesives or molten glass 27. The ends of a pair of lead-in wires 28, fixed together by a bead 30, are mounted on the foremost ends of a pair of the connector pins 20 extended from the small hole 23*a*, and an electrode 24 is mounted on the foremost ends of the lead-in wires 28. In the illustrated embodiment, the flat plate glass 23 has a hole 23*b* formed in a central portion thereof, on which an exhaust pipe 26 is mounted by molten glass 27. The fluorescent lamp body is evacuated through the exhaust pipe 26 and filled with a predetermined quantity of mercury and argon gas in a manner similar to the first-mentioned embodiment, after which the exhaust pipe 26 is subjected to chipping off (sealing) to form a flat type fluorescent lamp. It will be noted in this embodiment that the connector pins 20** may be directly connected to a connector (not shown) to thereby energize the electrodes.

As described above, in accordance with the present invention, the fluorescent lamp body is of the flat type and a pair of electrodes are provided through button stems or connector pins, and hence, the lamp itself has a wide light emitting area and may provide illumination of even brightness different from prior art fluorescent lamps. In addition, the device of the present invention may be directly connected to an electrical energizing circuit without requiring mounting base portions to be part of the fluorescent lamp body. Accordingly, the fluorescent lamp of the present invention may afford excellent effects when it is incorporated into an illumination device or the like. Furthermore, while the prior art fluorescent lamp has its opposite ends provided with base portions, resulting in the extended overall length thereof, it will be appreciated in the present invention that the base need not be provided and the energizing lead-in wires or connector pins are positioned at the rear of the fluorescent lamp to thereby reduce the overall length of the lamp and as a consequence, the fluorescent lamp may be incorporated into a display device or the like in a compact fashion without occupying as large a space for the lamp.

Moreover, since the position of electrodes may be freely set to the desired location without being limited to the opposite ends of the lamp as encountered in the prior art devices, it is extremely advantageous in mounting the fluorescent lamp and in connection thereof to the energizing circuit.

What is claimed is:

1. A flat type fluorescent lamp comprising:

a molded plate glass member in the shape of an upside-down dished generally rectangular plate and having a peripheral joining edge, said dished glass member having a dished light emitting surface;

a generally rectangular flat plate glass member having a peripheral joining edge overlapping the peripheral joining edge of said dished glass member, said peripheral joining edges of said glass members being sealingly joined together with said flat glass member below said upside-down dished glass member to form a hollow flat type fluorescent lamp body, said flat glass member having a pair of holes extending generally perpendicularly through flat surface portions thereof, said holes being located at opposite ends of said hollow lamp body and spaced inwardly from said peripheral joining edge;

a pair of electrodes mounted to said flat glass member in the vicinity of respective holes in said flat glass member and being spaced from said flat glass member in a direction substantially perpendicular to the surface of said flat glass member, said pair of electrodes being sealed in said fluorescent lamp body; and a respective pair of electrical conductors connected to and supporting each of said electrodes and passing through respective holes in said flat glass member to extend generally perpendicularly to said flat glass member and to electrically connect said electrodes to the outside of said lamp body.

2. The flat type fluorescent lamp of claim 1 comprising two exhaust pipes, each having an enlarged button stem at an end portion thereof, said holes in said flat glass member being larger in diameter than the outside diameter of said exhaust pipe but smaller in diameter than the outside of said button stem, said exhaust pipes being sealingly connected to said flat glass member in communication with a respective one of said holes, said pairs of electrical conductors respectively passing through said button stems to the inside of said lamp body.

3. The flat type fluorescent lamp according to claim 1 or 2 wherein said pairs of electrical conductors pass uprightly through said flat glass member, each pair of electrical conductors supporting a respective electrode at the ends of said conductors, spaced from the surface of said flat glass member; said electrical conductors comprising connector pins extending through said holes in said flat glass member and being sealed to said glass member at said holes, and respective lead-in wires connected to the ends of said connector pins interior of said lamp body, said lead-in wires being connected to said electrodes for spacing said electrodes from the interior surface of said lamp body; said lamp further comprising an insulating bead connecting a pair of said lead-in wires together; and an exhaust pipe connected to said flat glass member through which said lamp body is evacuated and filled with a predetermined quantity of mercury and argon gas.

4. The flat type fluorescent lamp of claim 3 wherein said flat plate glass is formed with a hole in a central portion thereof, said exhaust pipe being mounted in communication with said hole by means of molten glass.

* * * * *